US006216712B1

(12) United States Patent
Lin et al.

(10) Patent No.: US 6,216,712 B1
(45) Date of Patent: Apr. 17, 2001

(54) CATCH-FREE SAFETY UMBRELLA

(75) Inventors: Chung-Kuang Lin; Jung-Jen Chang, both of Taipei Hsien (TW)

(73) Assignee: Fu Tai Umbrella Works, Ltd., Taipei Hsien (TW)

( * ) Notice: Subject to any disclaimer, the term of this patent is extended or adjusted under 35 U.S.C. 154(b) by 0 days.

(21) Appl. No.: 09/305,204

(22) Filed: May 5, 1999

(51) Int. Cl.[7] ..... A45B 25/22

(52) U.S. Cl. ..... 135/31; 135/23; 135/27; 135/28; 135/41; 135/43

(58) Field of Search ..... 135/23, 25.31, 135/27, 28, 31, 38, 40, 41, 43

(56) References Cited

U.S. PATENT DOCUMENTS 5,020,558 * 6/1991 Huang ..... 135/28 C
5,050,627 * 9/1991 Hengtzu ..... 135/23
5,794,637 * 8/1998 Figueroa ..... 135/28 X
5,826,678 * 10/1998 Yu ..... 135/23 X
5,909,746 * 6/1999 Doster et al. ..... 135/29 X
5,941,261 * 8/1999 Kouvaras et al. ..... 135/23 X

* cited by examiner

*Primary Examiner*—Carl D. Friedman
*Assistant Examiner*—Winnie Yip
(74) *Attorney, Agent, or Firm*—Dougherty & Troxell

(57) ABSTRACT

A safety umbrella includes: a central shaft; a rib assembly having a plurality of top ribs pivotally secured to an upper notch on the shaft each top rib pulled by a pulling rope to be tensioned towards an upper portion on the shaft, and a plurality of stretcher ribs each pivotally connected between each top rib and a runner slidably held on the shaft, with each stretcher rib forming an acute angle between the stretcher rib and the shaft; whereby upon opening of the umbrella, the tension force as effected by the pulling rope and acting upon each top rib will be transferred to each stretcher rib to form an upwardly orienting fraction force to lift the stretcher rib along the shaft to stably hold the rib assembly at an opening state; and a ball resiliently held in a lower portion of the shaft, whereby upon closing of the umbrella, the runner will be engaged with the ball for stably retracting the rib assembly at a folded condition, thereby eliminating the acute spring catches as found in a conventional umbrella and preventing from injury to the umbrella user.

10 Claims, 10 Drawing Sheets

FIG. 6
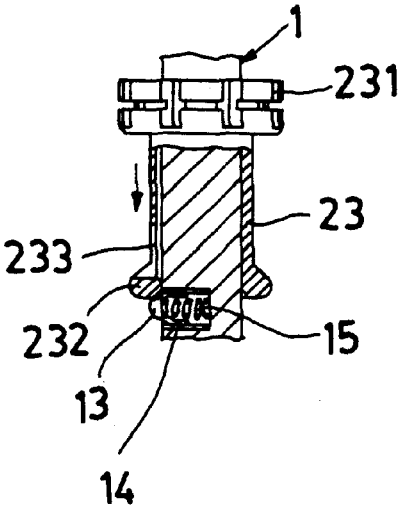
FIG. 7
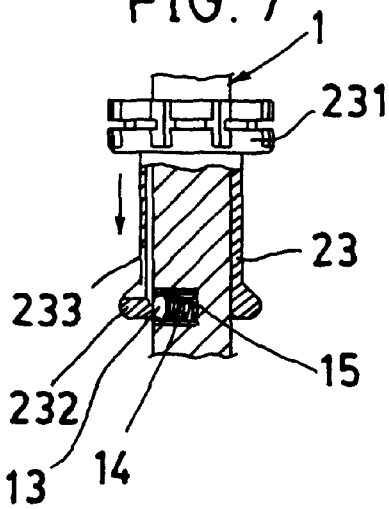
FIG. 8
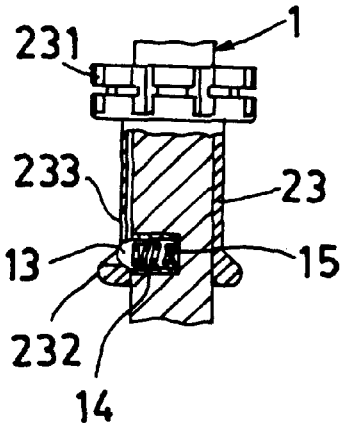
FIG. 9
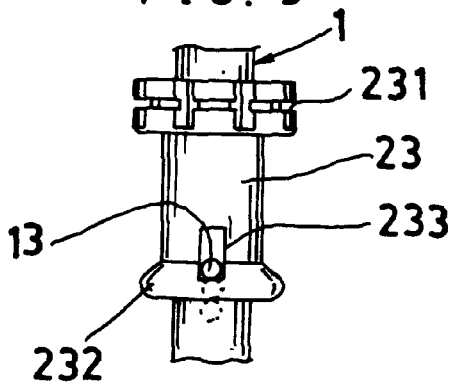
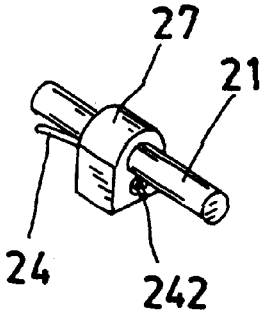
FIG. 10

CATCH-FREE SAFETY UMBRELLA

BACKGROUND OF THE INVENTION

As shown in FIG. 31, a conventional umbrella includes: a central shaft C having a plurality of top ribs T pivotally secured to an upper notch N on the shaft, a plurality of stretcher ribs S each pivotally connected between each top rib T and a runner R slidably held on the shaft; whereby upon opening of the umbrella, the runner R will be retained on an upper portion of the shaft by an upper spring catch C1 resiliently held on the shaft; and upon closing of the umbrella, the runner R will be retained on a lower portion of the shaft by engaging a slot R' formed in the runner with a lower catch C2 resiliently held on a lower portion of the shaft.

Since either upper catch C1 or lower catch C2 has an acute corner portion formed on the catch, it may easily injure an umbrella user when depressing the catch for closing or opening the umbrella.

The present inventor has found the drawbacks of the conventional umbrella and invented the present safety umbrella without spring catch.

SUMMARY OF THE INVENTION

The object of the present invention is to provide a safety umbrella including: a central shaft; a rib assembly having a plurality of top ribs pivotally secured to an upper notch on the shaft each top rib pulled by a pulling rope to be tensioned towards an upper portion on the shaft, and a plurality of stretcher ribs each pivotally connected between each top rib and a runner slidably held on the shaft, with each stretcher rib forming an acute angle between the stretcher rib and the shaft; whereby upon opening of the umbrella, the tension force as effected by the pulling rope and acting upon each top rib will be transferred to each stretcher rib to form an upwardly orienting fraction force to lift the stretcher rib along the shaft to stably hold the rib assembly at an opening state; and a ball resiliently held in a lower portion of the shaft, whereby upon closing of the umbrella, the runner will be engaged with the ball for stably retracting the rib assembly at a folded condition, thereby eliminating the acute spring catches as found in a conventional umbrella and preventing from injury to the umbrella user.

BRIEF DESCRIPTION OF THE DRAWINGS

FIG. 6 is an illustration showing a lowering of the runner to approximate the ball resiliently held in the shaft.

FIG. 7 shows a depression of the ball by the lowered runner, following FIG. 6.

FIG. 8 shows an engagement between the ball and the runner for stably closing the umbrella of the present invention.

FIG. 9 is a front view of FIG. 8.

FIG. 10 shows a connection between the pulling rope and the top rib.

DETAILED DESCRIPTION

Figures 1, 2:
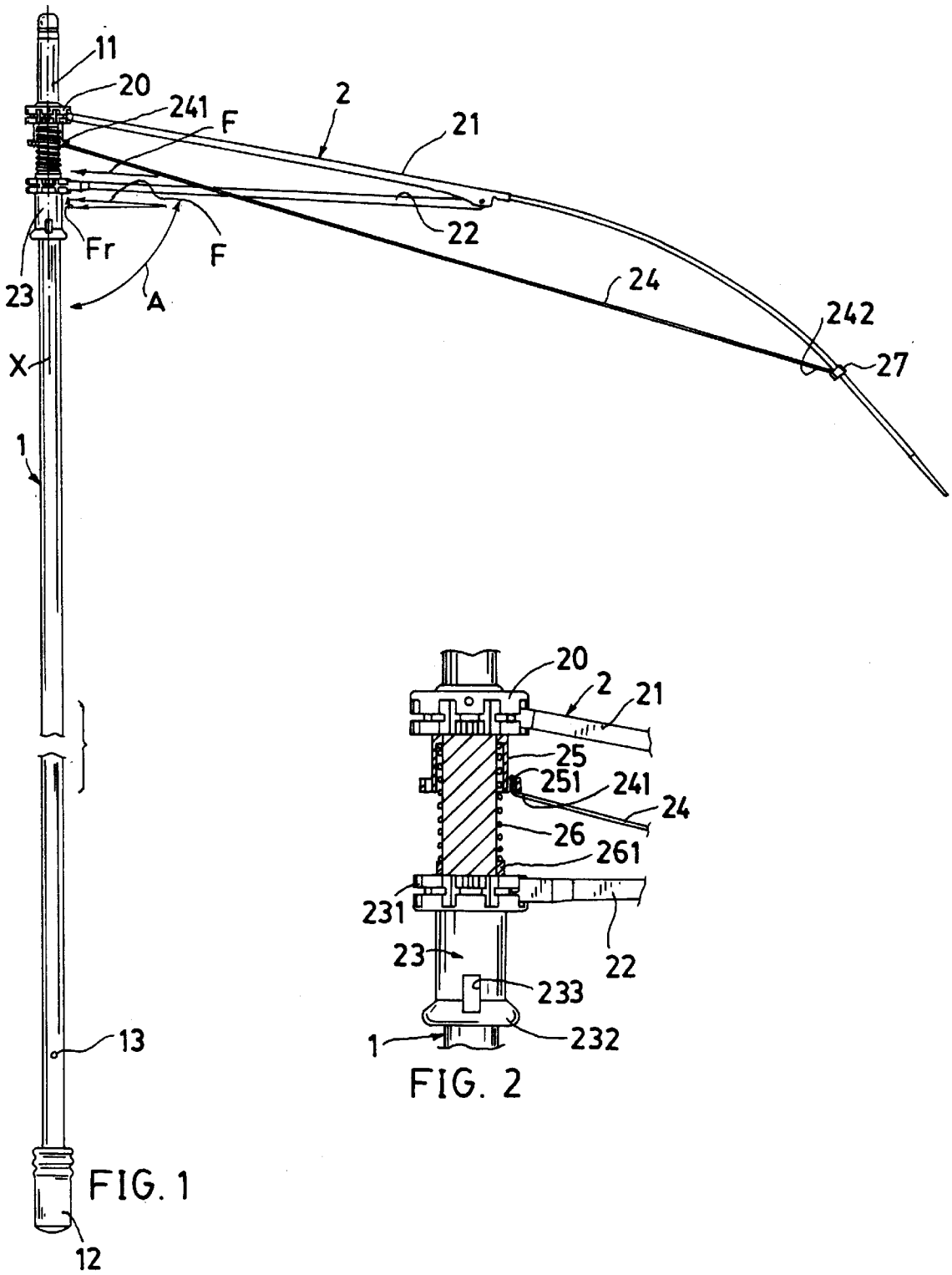
FIG. 1 is an illustration showing an opening umbrella of the present invention.
FIG. 2 is a partially enlarged illustration of FIG. 1.
Figure 3:
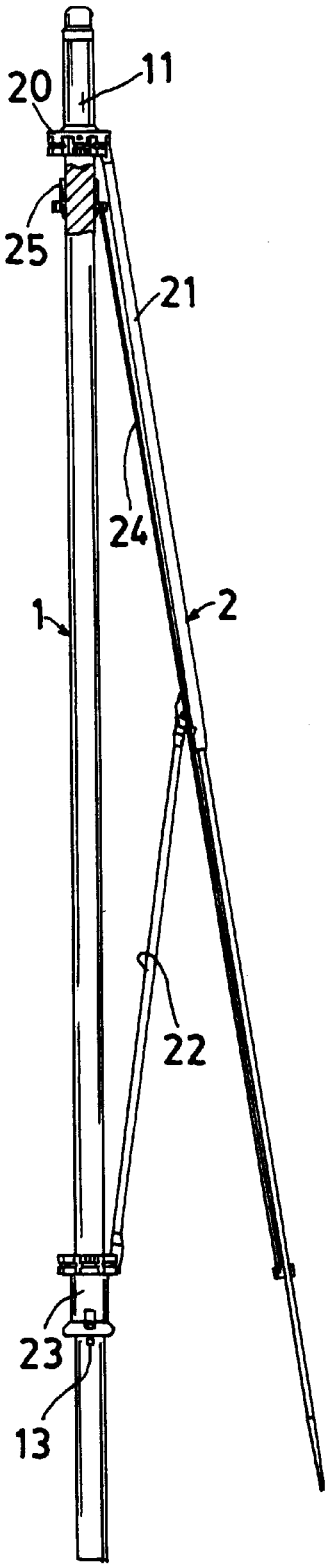
FIG. 3 is an illustration showing a closed umbrella of the present invention.
Figure 4:
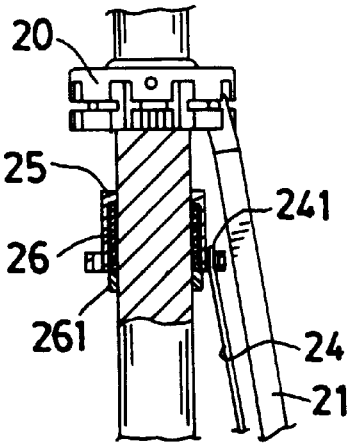
FIG. 4 is a partially enlarged illustration of FIG. 3.

As shown in FIGS. 1~16, the safety umbrella of the present invention comprises: a central shaft 1; a rib assembly 2 having a plurality of top ribs 21 each pivotally secured to an upper notch 20 formed on top end portion 11 of the shaft 1, and a plurality of stretcher ribs 22 each pivotally connected between each top rib 21 and a runner 23 slidably held on the shaft 1; a plurality of pulling ropes 24 each pulling each top rib 21 towards a collar 25 disposed around the shaft 1; and a ball 13 resiliently held in the shaft 1 adjacent to a grip 12 secured to a lower portion of the shaft 1. Each stretcher rib 22 defines an acute angle A (or a right angle) between the stretcher rib 22 and the shaft 1 (from the runner towards the grip 12) when the umbrella is opened. A longitudinal axis X is defined at a longitudinal center of the shaft 1.

Each pulling rope 24 may be made of Nylon, or other materials light in weight and durable in strength. The rope 24 may also be substituted with wire, string, or threads.

Each pulling rope 24 includes: an inner rope end 241 secured on a collar 25 disposed around the shaft 1 (FIGS. 11~13), and an outer rope end 242 secured with an outer portion of the top rib 21 by means of a retainer 27 fixed on the top rib as shown in FIG. 10.

The collar 25 is resiliently tensioned on a tension spring 26 retained on fixing ring or pin 261 fixed on an upper portion of the shaft 1 to tension the rope between the top rib 21 and the collar 25.

When the umbrella is opened as shown in FIG. 1, the top rib 21 is pulled and bent by the pulling rope 24 towards the upper portion of the shaft. A tension force on the top rib 21 as pulled by the rope 24 will act upon each stretcher rib 22 which in turn transfers the tension force F towards the runner to form a force fraction Fr to lift the stretcher rib 22 upwardly to prevent from a gravitational descending of the runner 23 and the rib assembly 2, thereby stably keeping the umbrella at an opening condition.

When subjected to an upwardly blowing strong wind, the pulling ropes 24 will pull the top ribs 21 and the stretcher ribs 22 centripetally towards the axis X to help stabilize the rib assembly 2 at their opening condition and to prevent from inversion of the umbrella cloth as secured on the rib assembly.

Even when the umbrella is closed to retract the rib assembly towards the shaft, the pulling ropes 24 may still be tensioned by the tension spring 26 which urges the collar 25 upwardly, thereby preventing from the loosening or tangling of the ropes 24 with one another.

Figure 11:
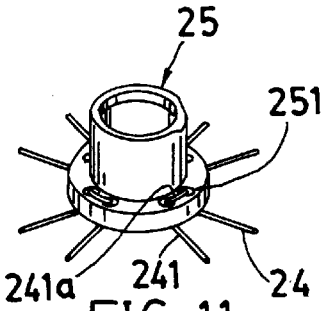
FIG. 11 shows the connection of the pulling ropes on the collar disposed on the shaft of the present invention.
Figure 12:
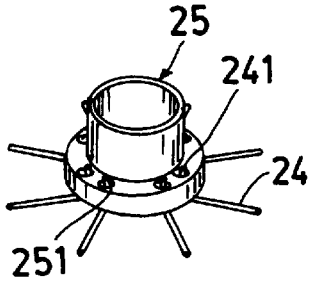
FIG. 12 shows another connection of the ropes on the collar.
Figure 13:
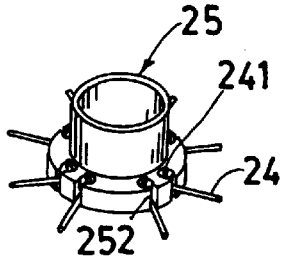
FIG. 13 shows further connection of the ropes with the collar.

The inner rope end 241 of the pulling rope 24 may be formed as a loop 241*a* to be retained in two neighboring rope holes 251 formed in the collar 25 as shown in FIG. 11. The rope 24 may also be individually secured to the collar 25 as shown in FIG. 12; or the inner rope end 241 of each rope is embedded into a rope slot 252 formed in the collar 25 as shown in FIG. 13.

The ball 13 having a spherical or arcuate surface is resiliently held in the central shaft 1 adjacent to the grip 12. The ball 13 is linked with a spring 15 retained in a ball holder 14 fixed in the central shaft 1 so that the ball 13 is urged outwardly by the spring 15 beyond a tube surface of the central shaft 1 to be engaged with a ball hole 233 formed in runner 23 when closing the umbrella.

Figure 5:
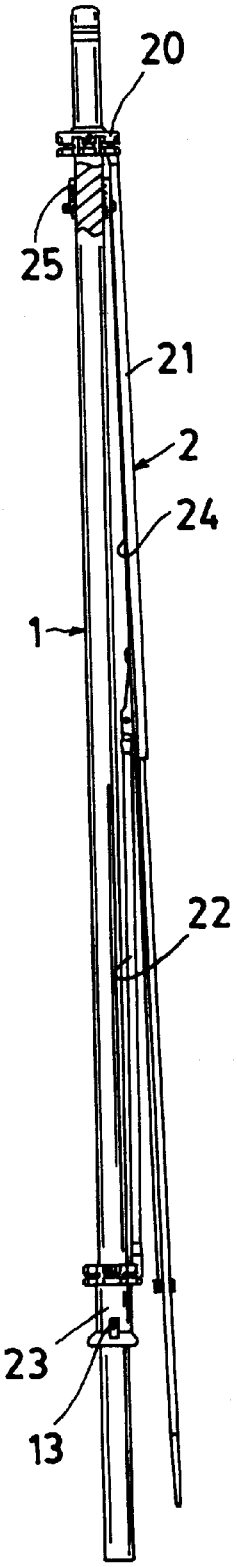
FIG. 5 is an illustration showing a stably folded umbrella of the present invention.

The runner 23 includes a ferrule 231 circumferentially formed on the runner for pivotally connecting the stretcher ribs 22 on the ferrule, a lower rim 232 formed on a bottom portion of the runner 23 having the ball hole 233 formed in the runner adjacent the lower rim 232; whereby when lowering the runner 23 when closing the umbrella, the lower rim 232 will depress the ball 13 inwardly into the holder 14 as shown in FIGS. 6, 7; and the ball 13 will be urged outwardly as restored by the spring 15 to engage the hole 233 for stably locking the runner 23 on a folded or closed state as shown in FIGS. 8, 9 and 5.

For opening the umbrella, the runner 23 can be raised upwardly by reversing the foregoing umbrella-closing procedure, namely, from FIG. 8 back to FIG. 6, the ball will be first retracted by the lower rim 232 (FIG. 8); and the runner 23 will then leap over the ball 13 in order to be unlocked and lifted for opening the umbrella as shown in FIG. 1.

After opening the umbrella, the rib assembly 2 is stably retained on the upper portion of the shaft by the pulling ropes 24, thereby eliminating the conventional upper spring catch held on the upper portion of the shaft for preventing injury to the umbrella user.

Upon closing of the umbrella, the runner 23 is lowered to retract the ball which will then be automatically restored for locking the runner, thereby greatly minimizing the chance to touch or injure the user's hand. Meanwhile, the ball is so small and has a smooth spherical ball surface, causing no injury to the umbrella user. So, the present invention also provides a safety umbrella by eliminating the conventional lower spring catch adjacent the grip.

Figure 14:
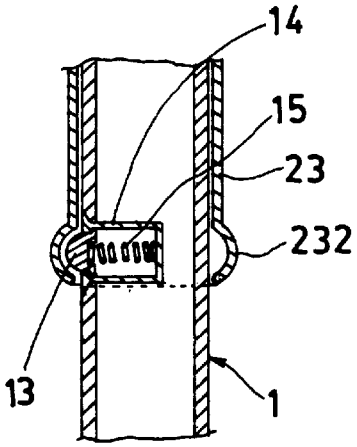
FIG. 14 shows another modification of the ball and the runner of the present invention.

As shown in FIG. 14, the lower rim 232 having an annular arcuate groove recessed in the rim 232 of the runner 23 will be engaged with the ball 13 as resiliently urged by the spring 15 and held in the holder 14 fixed in the shaft for stably locking the runner at it folded state.

Figure 15:
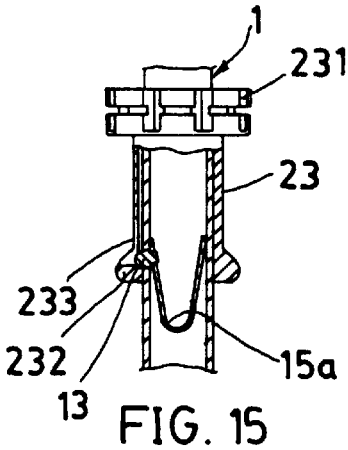
FIG. 15 shows still another modification of the ball with the runner of this invention.

As shown in FIG. 15, the ball 13 is fixed on a V-shaped spring 15 fixed in the shaft 1 for urging the ball 13 outwardly to be engaged with the ball hole 233 formed in the runner 23 for stably locking the runner at a closed state of the umbrella.

Figure 16:
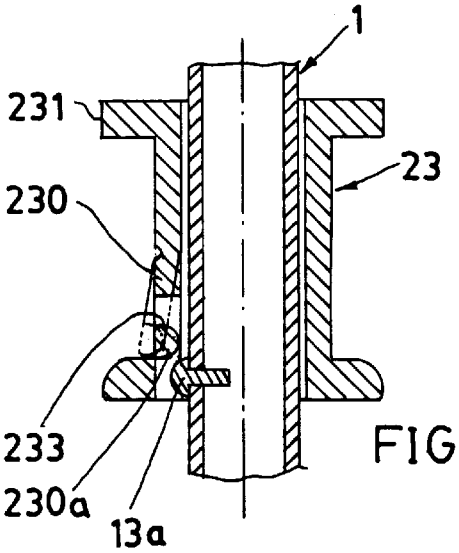
FIG. 16 shows further modification of the ball with the runner of this invention.
Figure 17:
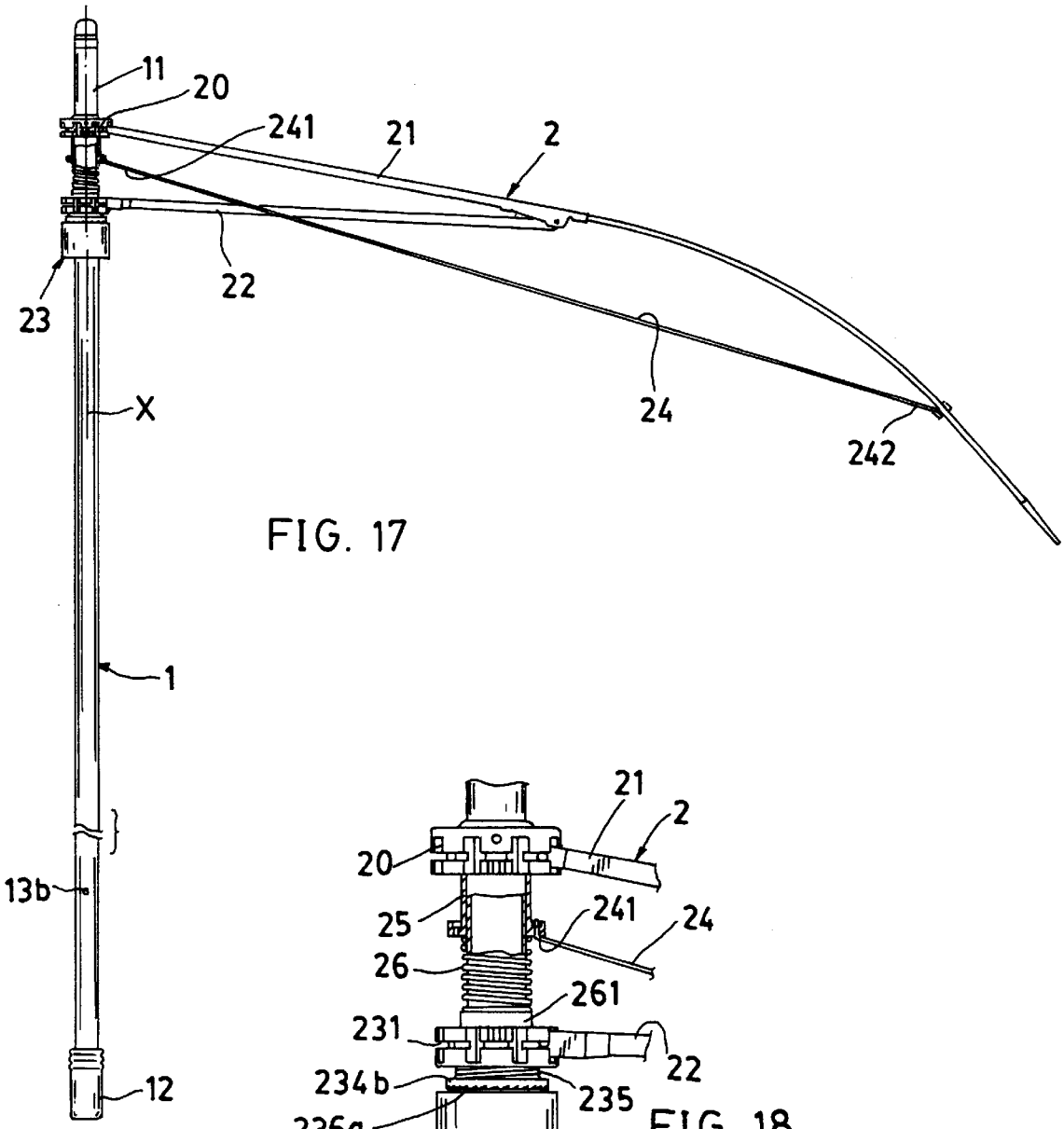
FIG. 17 is an illustration of another preferred embodiment of the present invention when opened.
Figure 18:
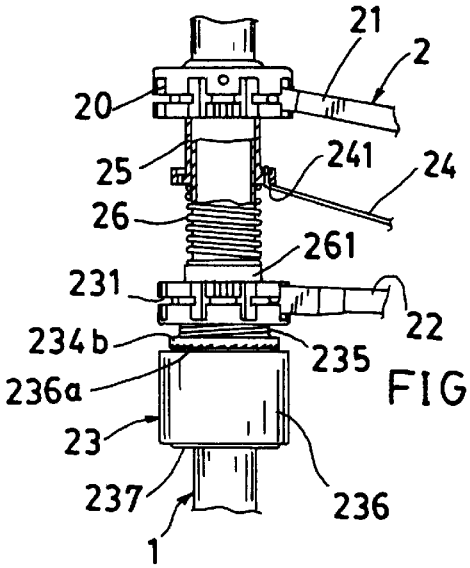
FIG. 18 is a partially enlarged illustration of FIG. 17.
Figure 19:
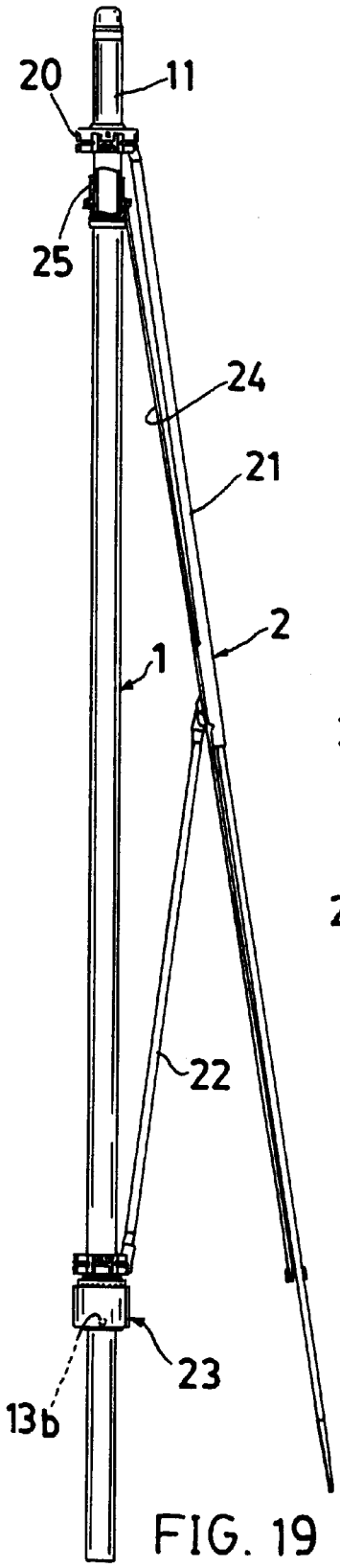
FIG. 19 shows a closed umbrella as folded from FIG. 17.
Figure 20:
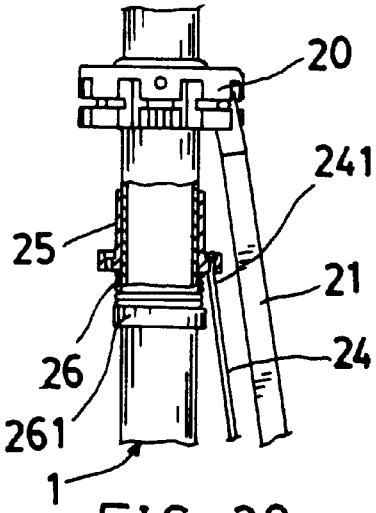
FIG. 20 is a partially enlarged view of FIG. 19.
Figure 21:
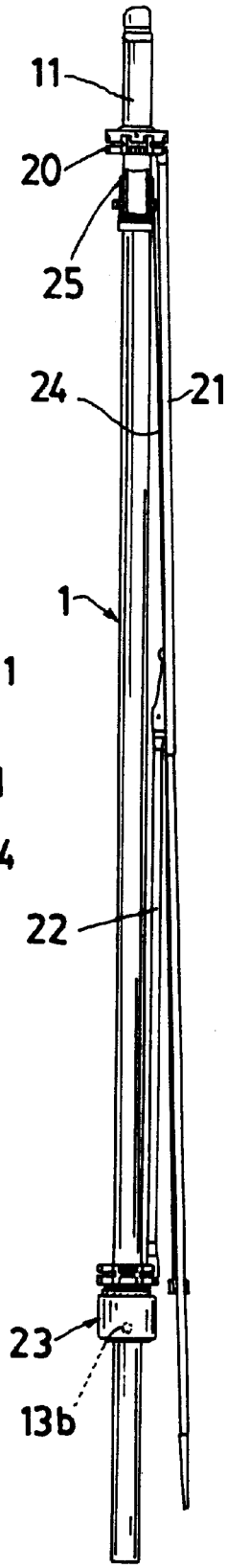
FIG. 21 shows a stably closed umbrella as further folded from FIG. 19.

As shown in FIG. 16, the ball 13 has been modified to be a ball-headed pin 13*a* inserted into the shaft 1, and the runner 23 is formed with a tab 230 hingedly secured to the runner 23 having the ball hole 233 formed in the tab 230 for engaging the ball-headed pin 13*a* when closing the umbrella. The tab 230 has a bottom rim 230*a* resiliently urged outwardly by the ball-headed pin 13*a*, whereby when the bottom rim 230*a* is leaving from the ball-headed pin 13*a*, the ball-headed pin 13*a* will be engaged with the hole 233 in the tab 230 for stably locking the runner 23 at its folded condition.

Another preferred embodiment of the present invention is shown in FIGS. 17~29, in which the runner 23 and the ball 13 have been modified to be the runner 23 and a ball 13*b* formed on a pin especially shown in FIGS. 22, 23 and 24~29.

The ball 13*b* slightly protrudes outwardly on the tube surface of the shaft 1, thereby causing no injury to an umbrella user and ensuring the safety function of this invention.

Figure 22:
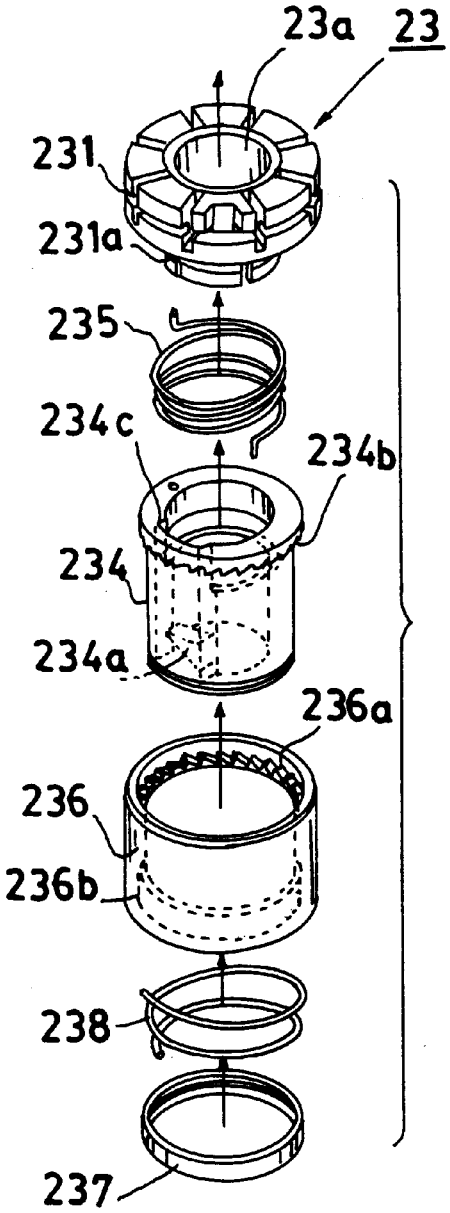
FIG. 22 is an exploded view of the runner of the umbrella as shown in FIG. 18.
Figure 23:
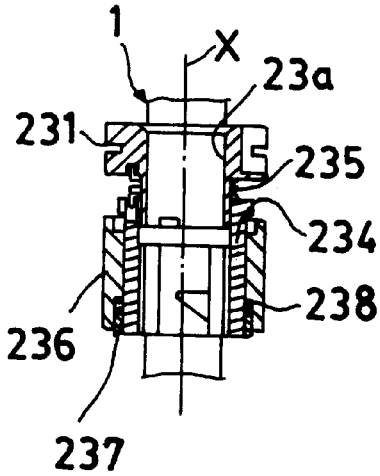
FIG. 23 is a sectional drawing of the runner as assembled from FIG. 22.
Figure 24:
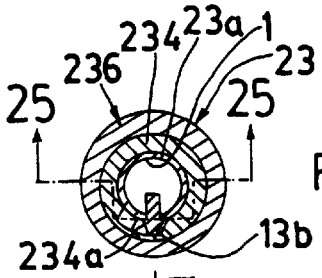
FIG. 24 is a cross sectional drawing when the runner is lowered to initially touch a ball on the shaft when closing the umbrella.
Figure 25:
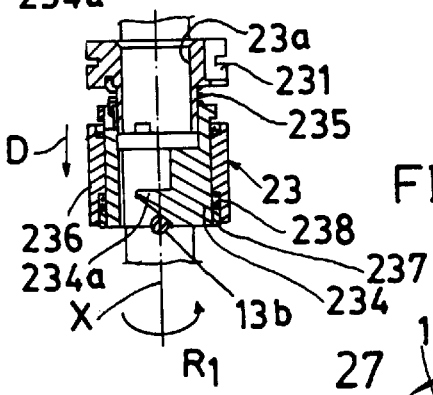
FIG. 25 is a longitudinal sectional drawing as viewed from 25—25 direction of FIG. 24.
Figure 26:
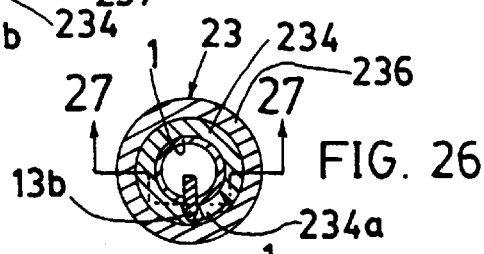
FIG. 26 shows a sloping block on the runner when separating from the ball, following FIG. 24.

The runner 23, defining a central through hole 23*a* as shown in FIG. 22, includes: a ferrule 231 for pivotally securing the stretcher ribs 22 thereon; an inner cylinder 234 resiliently connected under the ferrule 231 by a restoring coil spring 235 retained therebetween; an outer cylinder 236 rotatably coupled with and disposed around the inner cylinder 234 allowing a single-direction rotation of one cylinder relative to the other cylinder; a bottom retainer ring 237 secured to the bottom of the inner cylinder 234 for rotatably limiting the outer cylinder 236 for rotatably engaging the outer cylinder 236 about the inner cylinder 234; and a sloping block 234*a* formed in a bottom portion of the inner cylinder 234 contiguous to the central through hole 23*a* formed through the runner 23 and sloping downwardly concentrically about the axis X for engaging the ball 13*b* which is formed with a pin transversely fixed in the shaft 1 when closing the umbrella; whereby upon lowering (D) of the runner 23 to let the sloping block 234*a* of the inner cylinder 234 to be thrusted by the ball 13*b* (FIGS. 24, 25) to cause a rotation (R1) of the inner cylinder 234 to disengage the sloping block 234*a* from the ball 13*b* (FIGS. 26, 27), the coil spring 235 as twisted by the rotating inner cylinder 234 will store a spring energy of the coil spring 235 and then restore (R2) the inner cylinder 234 to engage the ball 13*b* on a retarding portion 234*r* formed on a top portion of the sloping block 234*b* (as shown from FIGS. 26, 27 to FIGS. 28, 29), thereby stably locking the runner 23 on its folded state.

The inner cylinder 234 has a first ratchet-teeth ring 234*b* annularly formed on an upper periphery of the inner cylinder 234, and the outer cylinder 236 has a second ratchet-teeth ring 236*a* annularly formed on an upper periphery of the outer cylinder 236 and engageable with the first ratchet-teeth ring 234*b* of the inner cylinder 234; whereby upon a rotation of the inner cylinder 234 in a counter clockwise direction (R1), the first ratchet-teeth ring 234*b* on the inner cylinder 234 will be slipped away from the second ratchet-teeth ring 236*a* on the outer cylinder 236, allowing a rotation of the inner cylinder 234 counter clockwise relative to the outer cylinder; and upon a rotation of the outer cylinder 236 counter clockwise (R1), the outer cylinder 236 will drive the inner cylinder 234 to rotate (R1) simultaneously.

Figure 27:
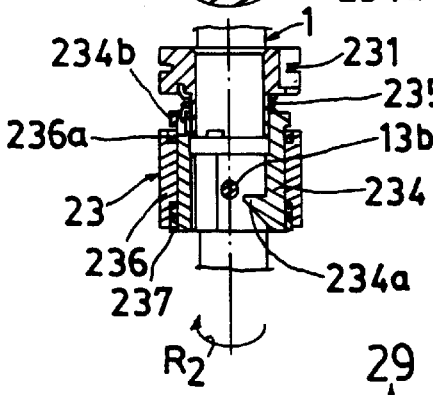
FIG. 27 is a longitudinal sectional drawing as viewed from 27—27 direction of FIG. 26.
Figure 28:
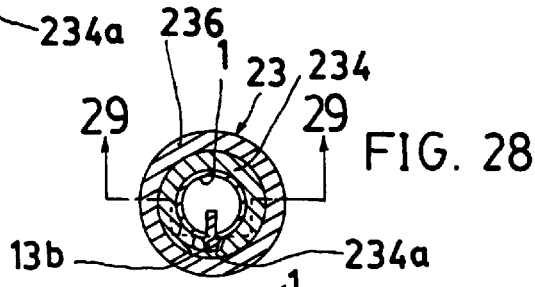
FIG. 28 is a cross sectional drawing when the runner is engaged and locked by the ball of the present invention.
Figure 29:
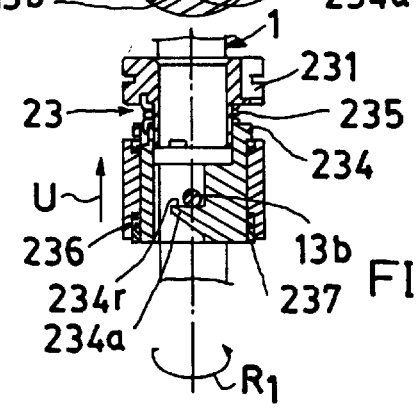
FIG. 29 is a longitudinal sectional drawing as viewed from 29—29 direction of FIG. 28.

The sloping block 234*a* is inclinedly tangential to the ball 13*b* when lowering the runner 23 for closing the umbrella (FIGS. 25, 24), with the sloping block 234*a* sloping concentrically downwardly in a counter clockwise direction (R1) about the longitudinal axis X, whereby upon lowering (D) of the runner 23, the sloping block 234*a* will be obstructed by the ball 13*b* and then thrusted by the ball 13*b* to rotate counter clockwise (R1) to separate the sloping block 234*a* from the ball 13*b* and to store the resilience of the coil spring 235 which is twisted by the rotating inner cylinder 234, the coil spring 235 will in turn restore and rotate the inner cylinder 234 clockwise (R2) as shown from FIG. 27 to FIG. 29 to engage the ball 13*b* on the retarding portion 234*r* formed on a top portion of the sloping block 234*a*, thereby stably locking the runner at a folded condition.

For opening the umbrella, the outer cylinder 236 is rotated counterclockwise (R1) as shown in FIG. 29 to disengage the sloping block 234*a* from the ball 13*b*, allowing an upward raising (U) of the runner 23 for opening the umbrella.

A bottom coil spring 238 is retained between the outer cylinder 236 and the bottom retainer ring 237 fixed on the inner cylinder 234; whereby upon lowering of the runner 23 when closing the umbrella by holding the outer cylinder 236, the second ratchet-teeth ring 236*a* will be disengaged from the first ratchet-teeth ring 234*b*, allowing a free rotation of the inner cylinder 234 clockwise (R2) for locking the ball 13*b* on the retarding portion 234*r* from FIG. 27 to FIG. 29 when the coil spring 235 automatically restore the inner cylinder 234 clockwise (R2).

The ferrule 231 includes a lug 231*a* formed on a lower periphery of the ferrule to be rotated within a groove 234*c* arcuately recessed in an inside wall of the inner cylinder 234 (FIG. 22), thereby limiting a rotating angle of the cylinders 234, 236 for easily controlling the engagement or disengagement between the runner 23 and the ball 13*b*.

Figure 30:
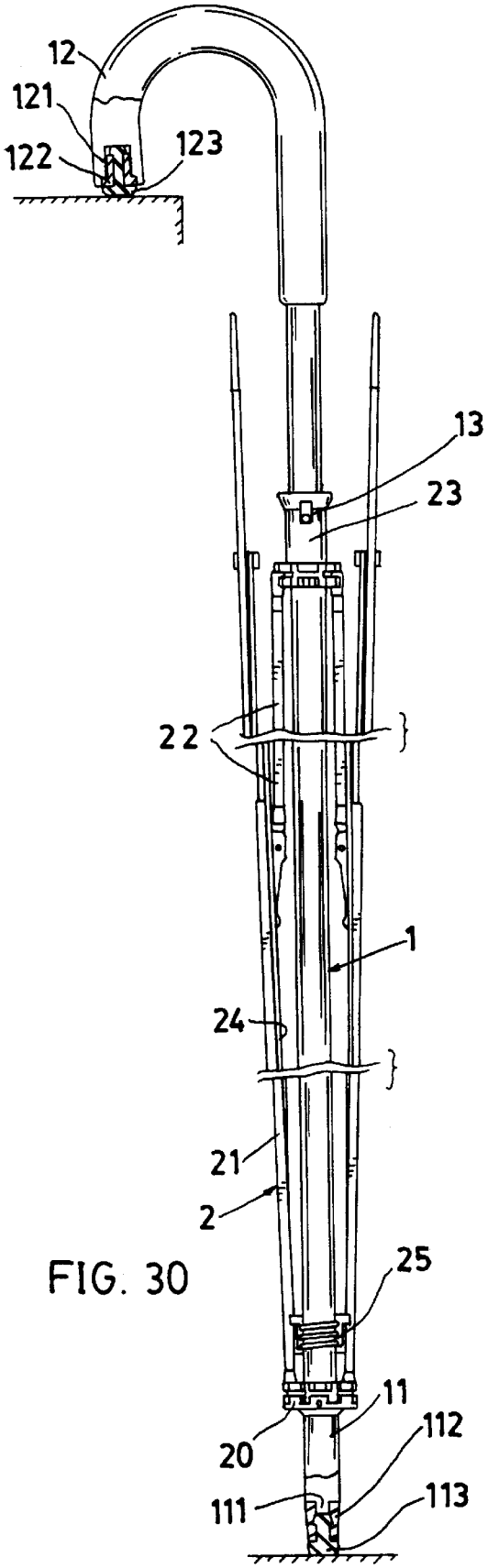
FIG. 30 is a partial sectional drawing showing an anti-slipping tip of the shaft and an anti-slipping end of the grip in accordance with the present invention.
Figure 31:
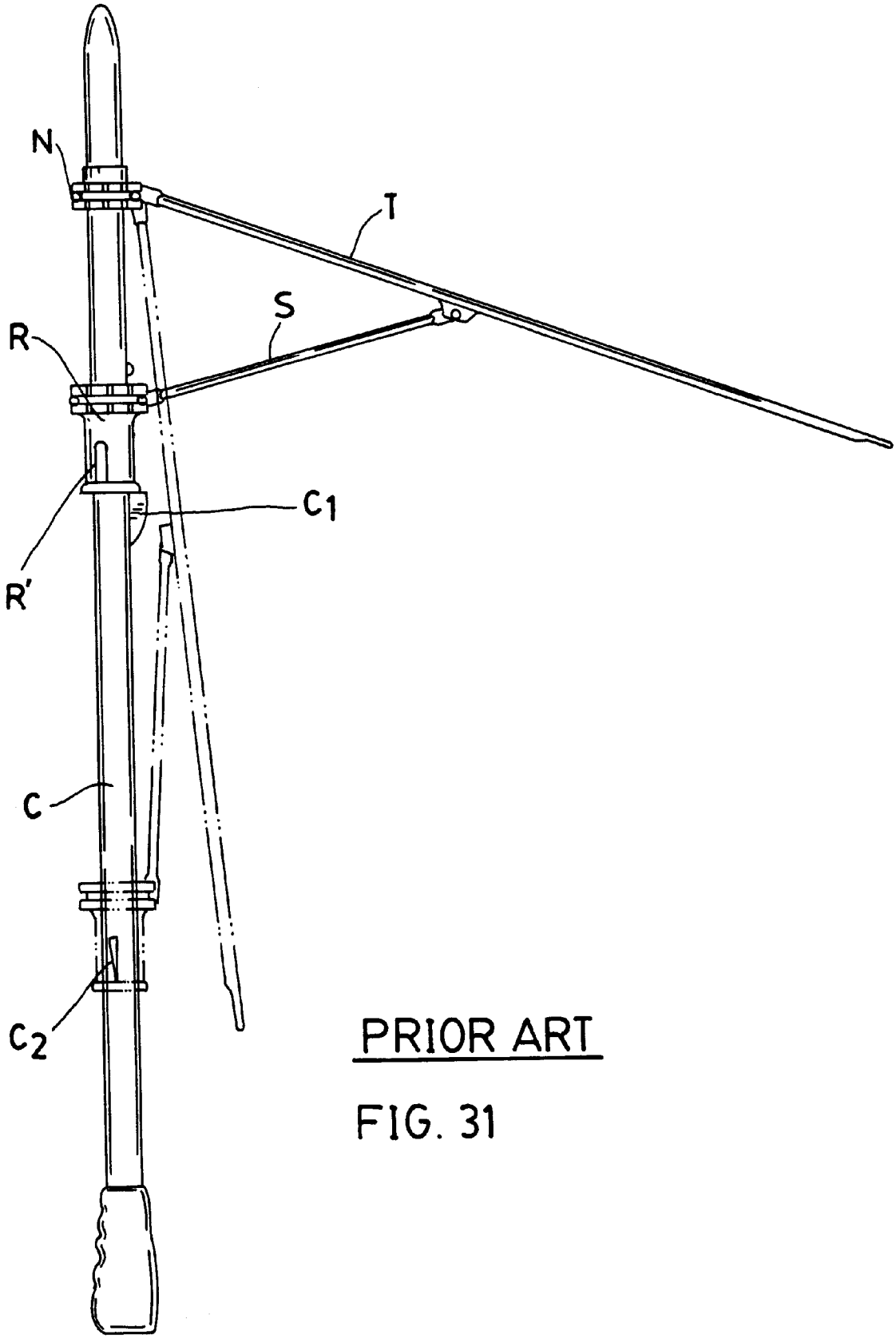
PRIOR ART FIG. 31
FIG. 31 shows a conventional umbrella.

As shown in FIG. 30, the top end portion 11 of the central shaft 1 includes an anti-slipping tip plug 113 (which may be made of rubber or the like) inserted in a tip sleeve member 112 (which may be made of plastic material) as jacketed on a tip 111 of the top end portion of the shaft 1 for preventing slippery of the tip on the ground surface; and the grip 12 has a hook end portion formed with a sleeve hole 121 therein, having a sleeve member 122 (which may be made of metal or plastic material) inserted into the sleeve hole 121 and an anti-slipping plug 123 (which may be made of rubber or the like) plugged into the sleeve member 122 for preventing slipping of the umbrella when hung on a supporting surface.

The present invention may be modified without departing from the spirit and scope of the present invention.

What is claimed is:

1. A safety umbrella comprising:

a central shaft having an upper notch formed on a top portion of the shaft and a grip formed on a lower portion of the shaft;

a ball retained in a lower portion of said shaft adjacent to the grip;

a rib assembly having an umbrella cloth secured thereon and including a plurality of top ribs each pivotally secured to the upper notch, and a plurality of stretcher ribs each pivotally connected between each said top rib and a runner slidably held on said shaft, each said stretcher rib defining an acute angle between the stretcher rib and said shaft from said runner to said grip of the umbrella when opened, said runner engaging with said ball resiliently retained in said shaft when closing the umbrella; and a plurality of pulling ropes each connected between an outer portion of each said top rib and a collar disposed about and resiliently held on an upper portion of said shaft by a tension spring retained on a retainer fixed on the upper portion of said shaft; whereby upon opening of the umbrella, each said pulling rope will pull each said top rib inwardly towards said shaft to arcuately bend each said top rib to force upon each said stretcher rib centipetally towards the runner and the shaft for stably resiliently keeping the rib assembly and the umbrella cloth at an opening condition; and upon closing of the umbrella by lowering said runner, said runner will be engaged with said ball to be stably locked at a folded condition.

2. A safety umbrella according to claim 1, wherein said ball is linked with a spring retained in a ball holder fixed in said shaft; and said runner having a hole formed therein to be engageable with said ball.

3. A safety umbrella according to claim 1 wherein said ball is secured to a V-shaped spring fixed in said shaft.

4. A safety umbrella according to claim 1, wherein said ball is resiliently held in said shaft and engageable with an annular groove annularly recessed in a lower rim of said runner.

5. A safety umbrella according to claim 1, wherein said ball is formed with a pin fixed in said shaft; and said runner having a ball hole formed in a tab hingedly secured to said runner; whereby upon lowering of said runner to engage said ball hole in said tab of said runner with said ball held on said shaft, said runner will be stably locked by said ball at a folded condition.

6. A safety umbrella according to claim 1, wherein said runner is formed with a central through hole therein and includes: a ferrule circumferentially formed on said runner for pivotally securing the stretcher ribs thereon; an inner cylinder resiliently connected under the ferrule by a restoring coil spring retained between said inner cylinder and said ferrule; an outer cylinder rotatably coupled with and disposed around the inner cylinder allowing a single-direction rotation of said inner cylinder relative to said outer cylinder; a bottom retainer ring secured to the bottom of the inner cylinder for rotatably limiting the outer cylinder for rotatably engaging the outer cylinder about the inner cylinder; and a sloping block formed in a bottom portion of the inner cylinder contiguous to the central through hole formed through the runner and sloping downwardly concentrically about a longitudinal axis of the shaft and engaging the ball which is formed on a pin transversely fixed in the shaft when closing the umbrella; whereby upon lowering of the runner to rotate the inner cylinder to allow the sloping block on the inner cylinder to be engaged and locked with the ball, the runner will be stably locked at a folded condition.

7. A safety umbrella according to claim 6, wherein said inner cylinder has a first ratchet-teeth ring annularly formed on an upper periphery of the inner cylinder of said runner, and the outer cylinder has a second ratchet-teeth ring annularly formed on an upper periphery of the outer cylinder and engageable with the first ratchet-teeth ring of the inner cylinder; whereby upon a rotation of the inner cylinder in a counter clockwise direction, the first ratchet-teeth ring on the inner cylinder will be slipped away from the second ratchet-teeth ring on the outer cylinder, allowing a rotation of the inner cylinder counter clockwise relative to the outer cylinder; and upon a rotation of the outer cylinder counter clockwise, the outer cylinder will drive the inner cylinder to rotate said inner and outer cylinders simultaneously.

8. A safety umbrella according to claim 7, wherein said runner includes a bottom coil spring retained between the outer cylinder and the bottom retainer ring fixed on the inner cylinder; whereby upon lowering of the runner when closing the umbrella by holding the outer cylinder, the second ratchet-teeth ring will be disengaged from the first ratchet-teeth ring, allowing a free rotation of the inner cylinder clockwise for locking the ball with said runner.

9. A safety umbrella according to claim 6, wherein said sloping block is inclinedly tangential to the ball when lowering the runner for closing the umbrella, with the sloping block sloping concentrically downwardly in a counter clockwise direction about the longitudinal axis, whereby upon lowering of the runner, the sloping block will be obstructed by the ball and then thrusted by the ball to rotate counter clockwise to separate the sloping block from the ball and to store the resilience of the coil spring which is twisted by the rotating inner cylinder, the coil spring will in turn restore and rotate the inner cylinder clockwise to engage the ball on the retarding portion formed on a top portion of the sloping block, thereby stably locking the runner at a folded condition.

10. A safety umbrella according to claim 1, wherein said top end portion of said shaft has an anti-slipping tip plug secured on a tip of said shaft; and said grip having an anti-slipping plug fixed on a hook end portion of said grip for preventing slippery of the umbrella from a supporting surface.

* * * * *